US009071894B2

(12) United States Patent
Galea et al.

(10) Patent No.: US 9,071,894 B2
(45) Date of Patent: Jun. 30, 2015

(54) HEARING PROTECTION SYSTEM

(71) Applicant: Vivonics, Inc., Waltham, MA (US)

(72) Inventors: Anna M Galea, Stow, MA (US); Eric Louis, North Chelmsford, MA (US); Kristen J. LeRoy, Somerville, MA (US)

(73) Assignee: Vivonics, Inc., Waltham, MA (US)

( * ) Notice: Subject to any disclaimer, the term of this patent is extended or adjusted under 35 U.S.C. 154(b) by 153 days.

(21) Appl. No.: 13/950,992

(22) Filed: Jul. 25, 2013

(65) Prior Publication Data

US 2014/0029756 A1 Jan. 30, 2014

Related U.S. Application Data

(60) Provisional application No. 61/676,007, filed on Jul. 26, 2012.

(51) Int. Cl.

| | |
|---|---|
| ***H04R 3/00*** | (2006.01) |
| ***G10K 11/178*** | (2006.01) |
| ***H04R 25/00*** | (2006.01) |

(52) U.S. Cl.

CPC ..... *H04R 3/00* (2013.01); *G10K 11/178* (2013.01); *H04R 25/606* (2013.01); *G10K 2210/1081* (2013.01); *G10K 2210/129* (2013.01); *H04R 2460/13* (2013.01)

(58) Field of Classification Search

None

See application file for complete search history.

(56) References Cited

U.S. PATENT DOCUMENTS

| | | | | |
|---|---|---|---|---|
| 8,521,239 | B2 * | 8/2013 | Hosoi et al. | 455/575.1 |
| 8,886,263 | B2 * | 11/2014 | Hosoi et al. | 455/575.2 |
| 2011/0319703 | A1 * | 12/2011 | Wiskerke et al. | 600/25 |

* cited by examiner

*Primary Examiner* — Paul Huber

(74) *Attorney, Agent, or Firm* — Iandiorio Teska & Coleman, LLP

(57) ABSTRACT

A hearing protection system including a detection subsystem configured to determine bone conducted sound vibrations and one or more actuators placed proximate a predetermined location on the skull of a user configured to generate cancellation vibrations out of phase with the bone conducted sound vibrations to mitigate the effect of bone conducted sound vibrations on the middle and/or inner ear of a user.

19 Claims, 14 Drawing Sheets

HEARING PROTECTION SYSTEM

RELATED APPLICATIONS

This application hereby claims the benefit of and priority to U.S. Provisional Application Ser. No. 61/676,007, filed on Jul. 26, 2012 under 35 U.S.C. §§119, 120, 363, 365, and 37 C.F.R. §1.55 and §1.78, which is incorporated by reference herein.

GOVERNMENT RIGHTS

This invention was made with U.S. Government support under Contract No. FA8650-08-M-6910, SBIR Phase I program, awarded by the United States Air Force. The Government may have certain rights in certain aspects of the subject invention.

FIELD OF THE INVENTION

This invention relates generally to a hearing protection system and more particularly to a hearing protection system which attenuates bone conducted sound vibrations.

BACKGROUND OF THE INVENTION

Some conventional hearing protection systems that target airborne vibrations include passive hearing protection systems and active hearing protection systems.

Conventional passive hearing protection systems rely on blocking airborne sound waves from entering the middle and inner ear of a user. Examples include earmuffs, earplugs, and the like. Conventional passive hearing systems typically offer about 22-24 dB of protection.

Conventional active-noise reduction (ANR) hearing systems typically rely on generating sound waves with the same amplitude and opposite polarity (180° out of phase) to the original sound waves. The original sound waves are typically recorded with microphones, electronically processed and cancellation sound waves are output from a transducer or speaker. The cancellation waves may be centered on a certain frequencies and may be tailored for different applications, e.g., an airplane cabin noise, engine propeller noise, resident frequencies, and the like. Central to ANR is the speaker effectiveness resulting from its placement and orientation. ANR typically offers an additional 20-22 dB of protection to passive hearing protection system.

The conventional hearing protection systems discussed above protect only against airborne sound vibrations. However, bone conducted sound vibrations can cause significant damage to the middle and inner ear. Three mechanisms by which bone conducted vibrations coupled to the inner ear and translated into sound include: 1) the vibrations can squeeze the ear canal creating vibrations in the ear within the canal (this serves to reinforce airborne vibrations and amplify ambient sound), 2) bone vibrations can cause the ear drum and/or inner ear bones to vibrate, mimicking the effect of air coupled vibrations, and 3) the vibrations of the structures surrounding the inner ear can cause hair cells themselves to vibrate, causing them to fire and create a direct perception of sound. All of the above are fairly local phenomena, i.e. no matter at which site the initial sound is coupled into the anatomy, it is when the induced bone conducted vibrations travel to the middle and inner ear that it becomes "sound", and perhaps more importantly, where the bone conducted vibrations can damage the fine structures of the middle and inner ear.

Conventional hearing protection systems which attempt to solve the problem of hearing loss due to bone conducted vibrations have resulted in varying levels of success. Other conventional hearing protection systems may rely on passive bone conducted sound attenuation. However, such conventional hearing protection systems attenuate vibrations coupled into the entire skull and are cumbersome and uncomfortable to wear.

SUMMARY OF THE INVENTION

In one aspect, a hearing protection system is featured. The hearing protection system includes a detection subsystem configured to determine the bone conducted sound vibrations. One or more actuators are placed proximate a predetermined location on the skull of a user configured to generate cancellation vibrations out of phase with the bone conducted sound vibrations to mitigate the effect of bone conducted sound vibrations on the middle and/or inner ear of a user.

In one embodiment, the one or more actuators may be configured to generate the cancellation vibrations about 180° out of phase with the bone conducted sound vibrations. The one or more actuators may generate cancellation vibrations having about the same amplitude as the bone conducted sound vibrations. The one or more actuators may be placed proximate the temporal bone of the skull. One of the one or more actuators may be placed proximate the mastoid and another of the one or more actuators may be placed proximate the squamous process. The detection subsystem may include one or more sensors configured to measure the bone conducted sound vibrations. The detection subsystem may be configured to calculate the bone conducted sound vibrations by measuring sound vibrations in air. The system may include a controller circuit coupled to the detection subsystem and the one or more actuators. The one or more actuators may be disposed in an earmuff of a headset. The one or more actuators may be disposed in the earmuff such that they are located proximate the temporal bone of the skull of a user. One of the actuators may be disposed in the earmuff such that it is proximate the mastoid and another of the actuators may be disposed in the earmuff such that it is proximate the squamous process. The detection subsystem may be disposed in the earmuff. The one or more sensors may include a microphone. The one or more actuators may include a piezoelectric transducer. The one or more actuators may include a voice coil. The one or more actuators may include a vibrating transducer.

In another aspect, a method of providing hearing protection to bone conducted sound vibrations is featured. The method includes determining bone conducted sound vibrations and generating cancellation vibrations out of phase with the bone conducted sound vibrations to mitigate the effect of bone conducted sound vibrations on the middle and/or inner ear of a user.

In one embodiment, the method may include the step of generating cancellation vibrations about 180° out of phase with the bone conducted sound vibrations. The method may include the step of generating cancellation vibrations having about the same amplitude as the bone conducted vibrations.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
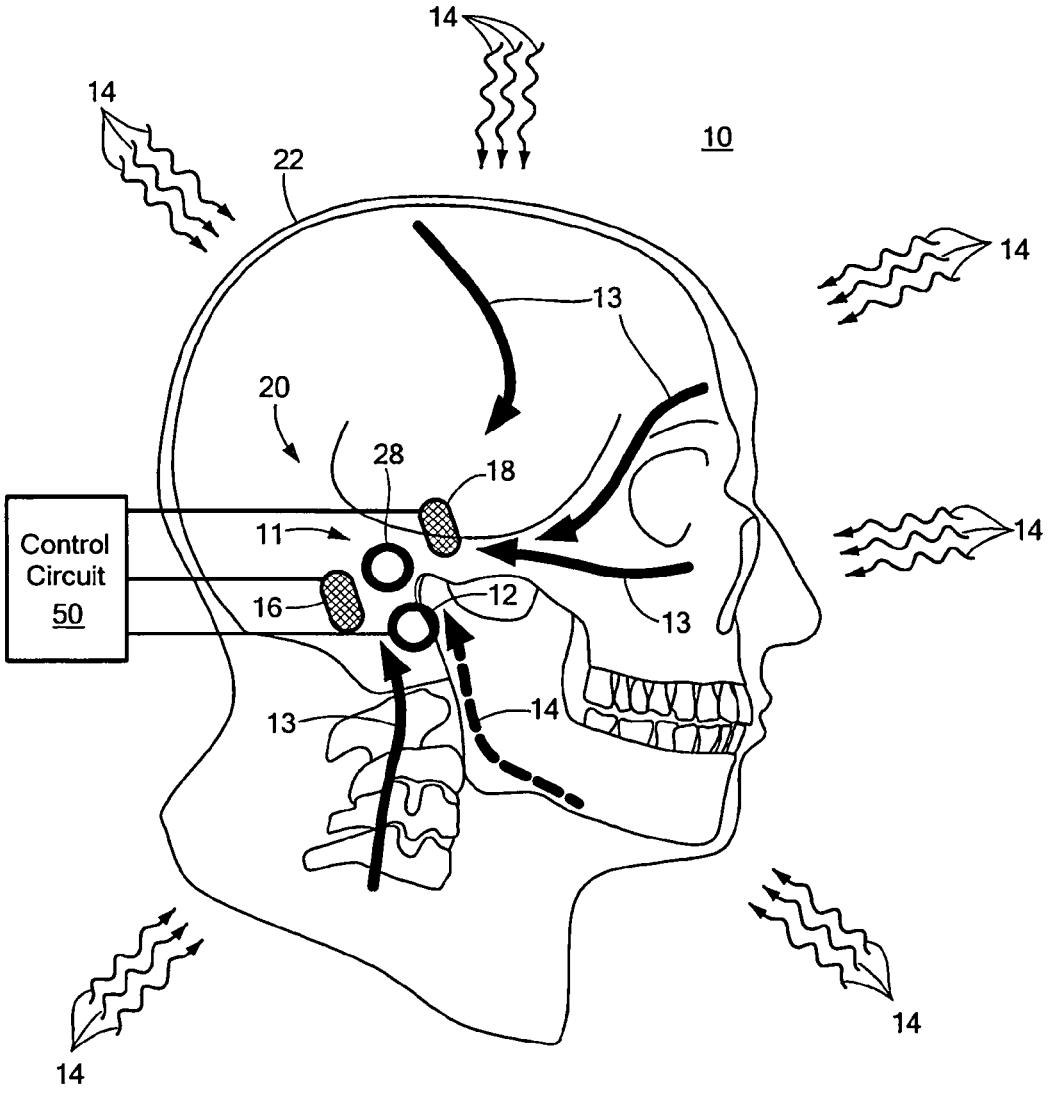
FIG. 1 is a schematic block diagram showing the primary components of one embodiment of the hearing protection system of this invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

There is shown in FIG. 1 one embodiment of hearing protection system 10 of this invention. System 10 includes detection subsystem 11 configured to determine bone conducted sound vibrations, e.g., exemplified by arrows 13. In one example, detection subsystem 11 may include one or more sensors, e.g., sensor 12 which measures sound vibrations 14 traveling in the air and calculate the bone conducted sound vibrations 13 produced from sound vibrations 14. Sensor 12 may be a microphone or similar type device which can measure bone conducted sound vibrations 13 or sound vibrations 14 in air.

Figure 2:
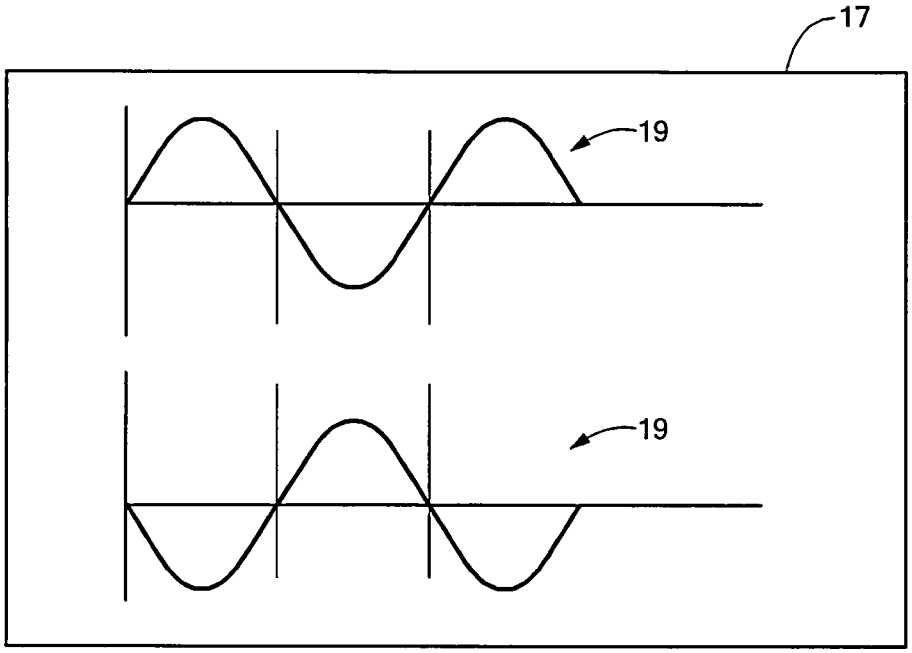
FIG. 2 depicts exemplary plots of a bone conducted vibration and one example of a cancellation vibration generated by the actuator shown in FIG. 1.

System 10 also includes one or more actuators, e.g., actuator 16 and/or actuator 18 placed proximate a predetermined location on human skull 22 of a user configured to generate cancellation vibrations out of phase with the bone conducted vibrations. The one or more actuators may be piezoelectric transducers, a voice coil, a vibrating transducer, or similar type device. In one example, the cancellation vibrations are preferably about 180° out of phase with bone conducted vibrations 13. The cancellation vibrations attenuate or mitigate the effect of bone conducted sound vibrations 13 on the middle and inner ear of a user. For example, caption 17, FIG. 2, shows plot 19 which is an example of a bone conducted sound vibration and plot 21 which is a cancellation vibration generated by one or more actuators 16, 18, FIG. 1, that is about 180° out of phase with the bone conducted vibration shown in plot 21, FIG. 2. Because the cancellation vibrations generated by actuators 16, 18 are out of phase with bone conducted vibrations they cancel or attenuate the effect of the bone conducted sound vibrations on the middle and inner ear to provide an effective and improved hearing protection system that has a relatively simple design.

Figure 3:
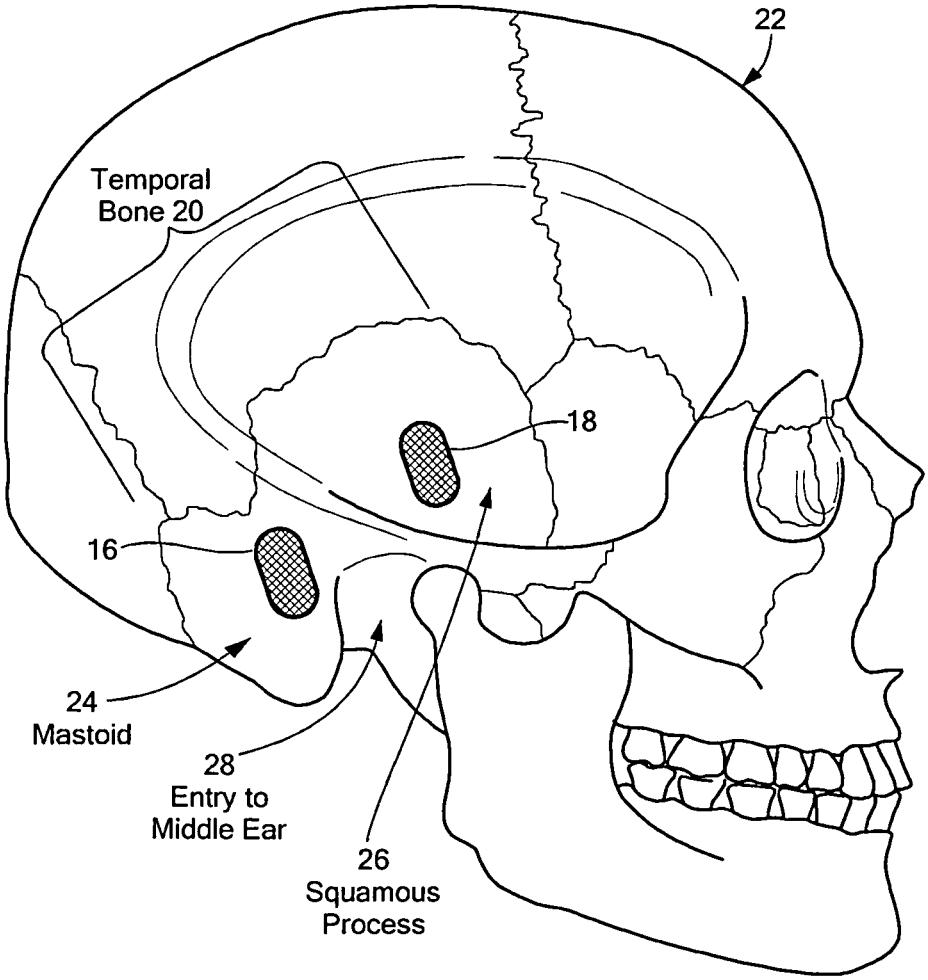
FIG. 3 shows a side-view showing in further detail the anatomy of the human skull shown in FIG. 1.
Figure 4:
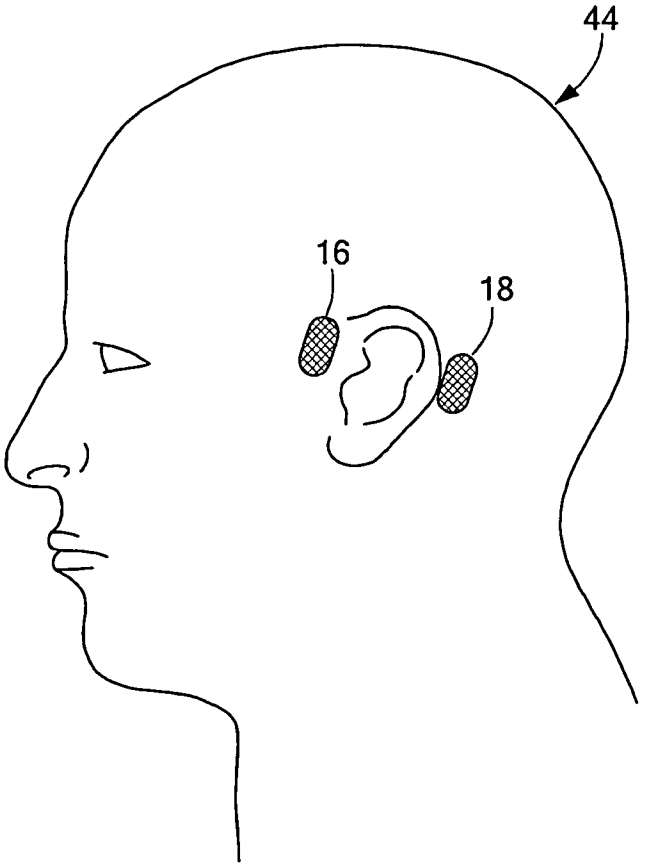
FIG. 4 is a three-dimensional side-view showing one example of the placement of the actuators shown in FIG. 1 proximate the mastoid and squamous process.

In one example, actuators 16, 18, FIG. 1, are placed proximate temporal bone 20 of near entry 28 to the middle and inner ear of skull 22. FIG. 3 shows in further detail one example of the placement of actuators 16, 18 on temporal bone 20. As shown in FIG. 3, entry 28 to middle and inner ears is ensconced within temporal bone 20 between mastoid 24 and squamous process 26. Mastoid 24 and squamous process 26 of temporal bone 20 are relatively thick bones that lie under the skin and a thin layer of fascia. Mastoid 24 and squamous process 26 have been shown to be effective locations for vibrators to translate sound to the inner ear. In accordance with hearing protection system 10 of one or more embodiments of this invention, this process may be used in reverse. Since mastoid 24 and squamous process 26 are very good at transducing sound to the ear, actuators 16, 18, are preferably placed proximate to them as shown to increase the effectiveness of the phase cancellation vibrations generated by actuators 16, 18 to more effectively attenuate bone conducted vibrations at these locations and protect entry of the bone conducted vibrations to the middle and inner ear. FIG. 4 shows a three-dimensional view of actuators 16, 18 in place proximate mastoid 24 and squamous process 26.

Figure 5:
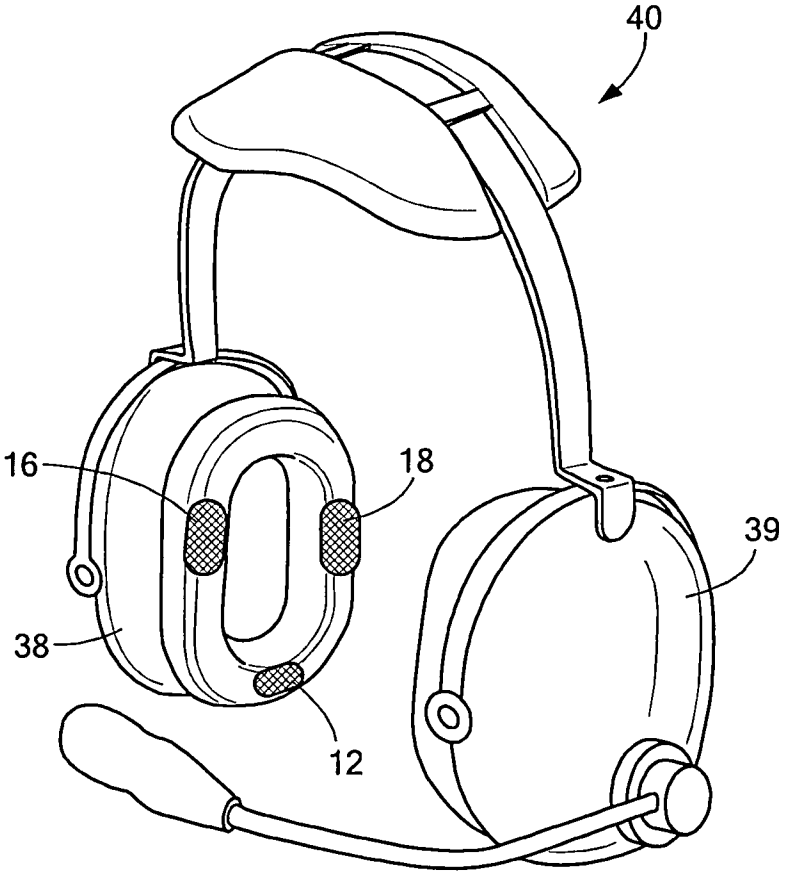
FIG. 5 shows three-dimensional views of one embodiment of the hearing protection system shown in FIG. 1 configured in a headset.
Figure 6B:
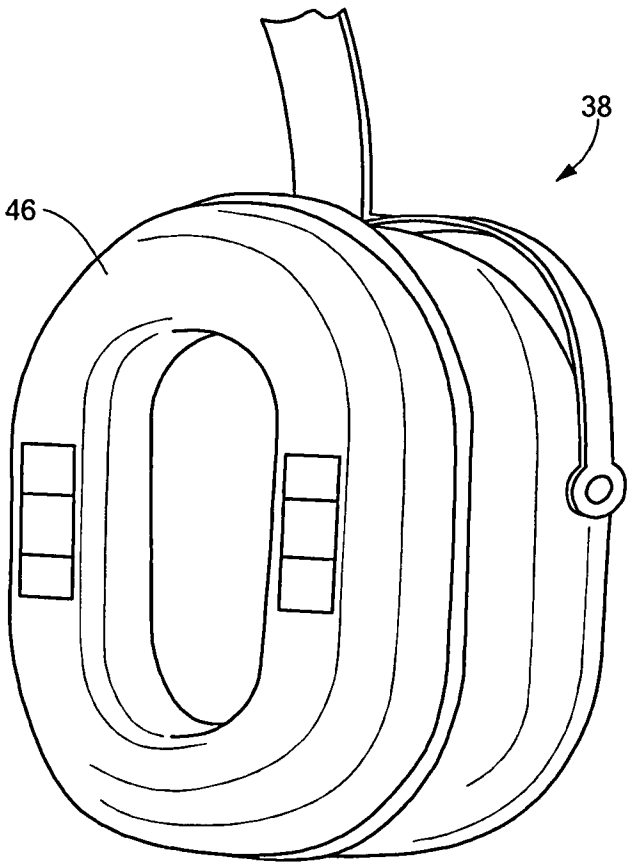
FIGS. 6A-6B show in further detail one example of the structure of the actuators in place in the seal of the earmuff shown in FIG. 5.
Figure 6A:
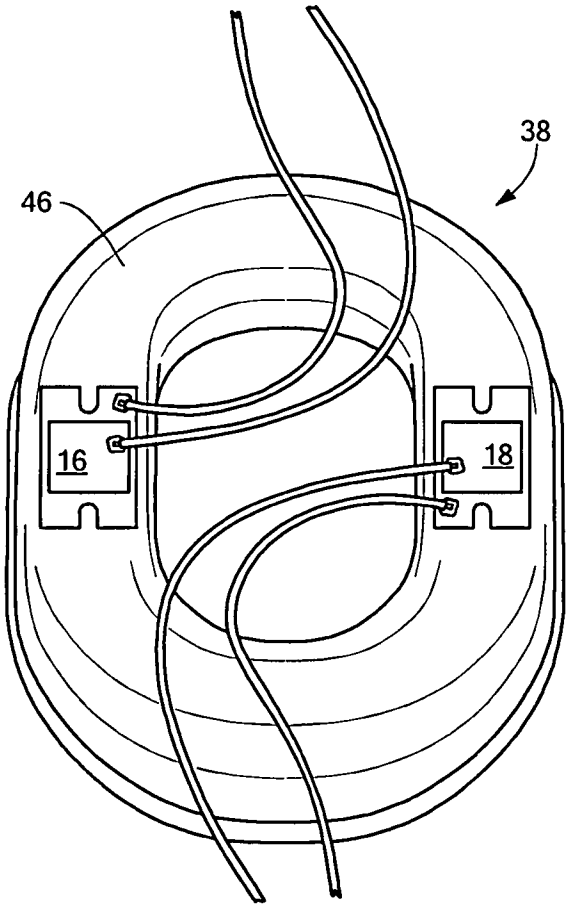

In one design, sensor 12, FIG. 1, and one or more actuators 16, 18, FIGS. 1, 3, and 4, may be placed in earmuff 38 FIG. 5, and/or earmuff 39 of headset 40 as shown. Preferably, actuators 16, 18 are placed in earmuff 38 and/or earmuff 39 such that actuators 16, 18 will be proximate mastoid 24, FIGS. 3 and 4, and squamous process 26 of temporal bone 20 of skull 22 when placed on the user, e.g., the locations of actuators 16, 18 shown on user 44, FIG. 4. FIG. 6A shows one example of an enlarged view of exposed actuators 16, 18 in place in seal 46 earmuff 38. FIG. 6B shows seal 46 covering actuators 16, 18.

Figure 7:
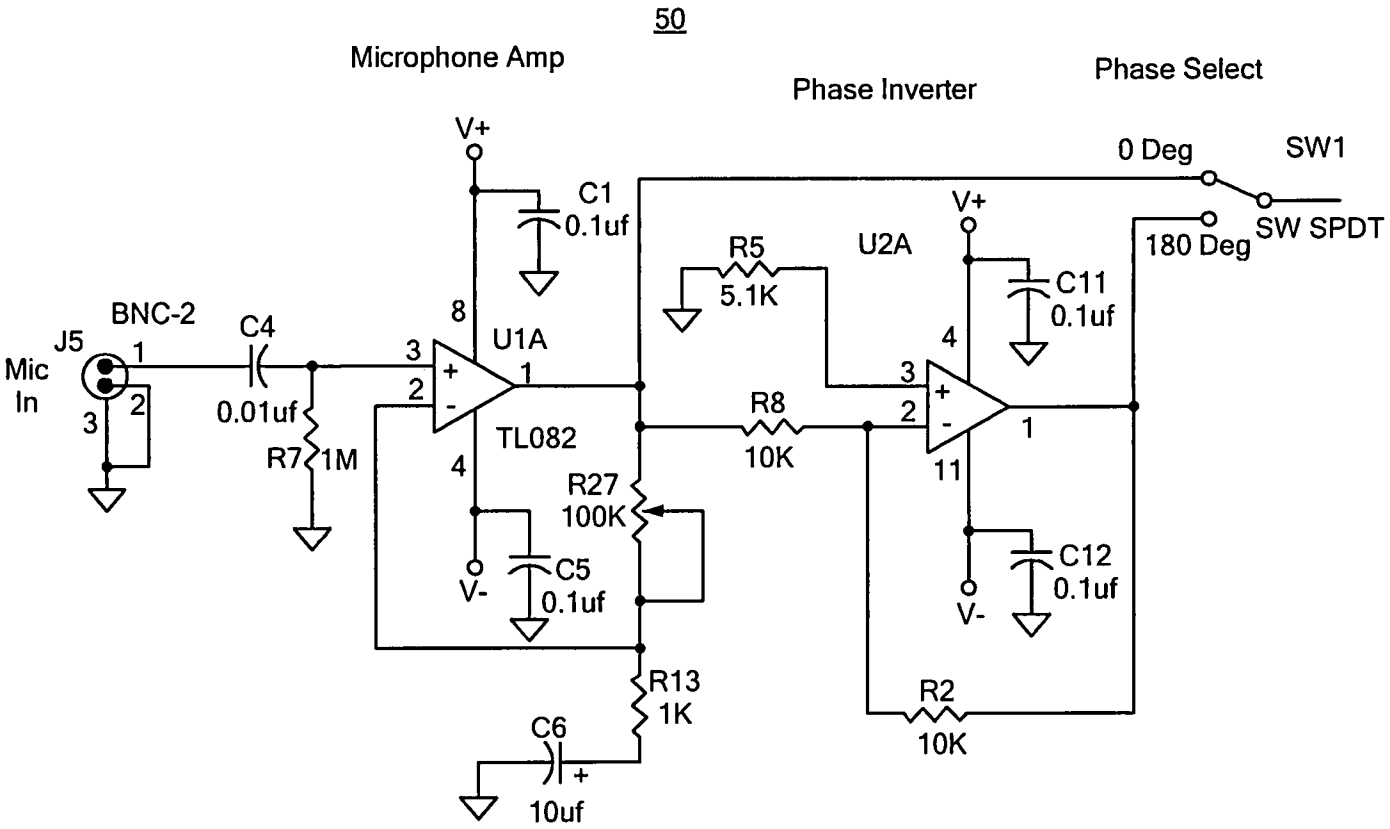
FIGS. 7-9 are circuit diagrams showing in further detail one example of the structure of the control circuit shown in FIG. 1.
Figure 8:
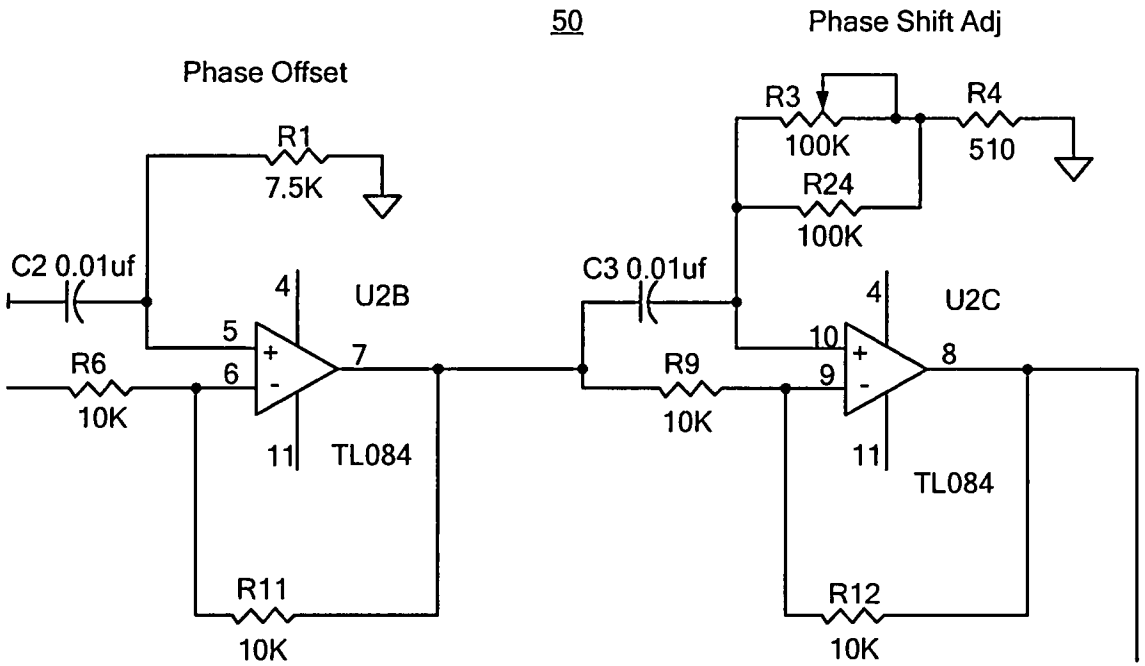
Figure 9:
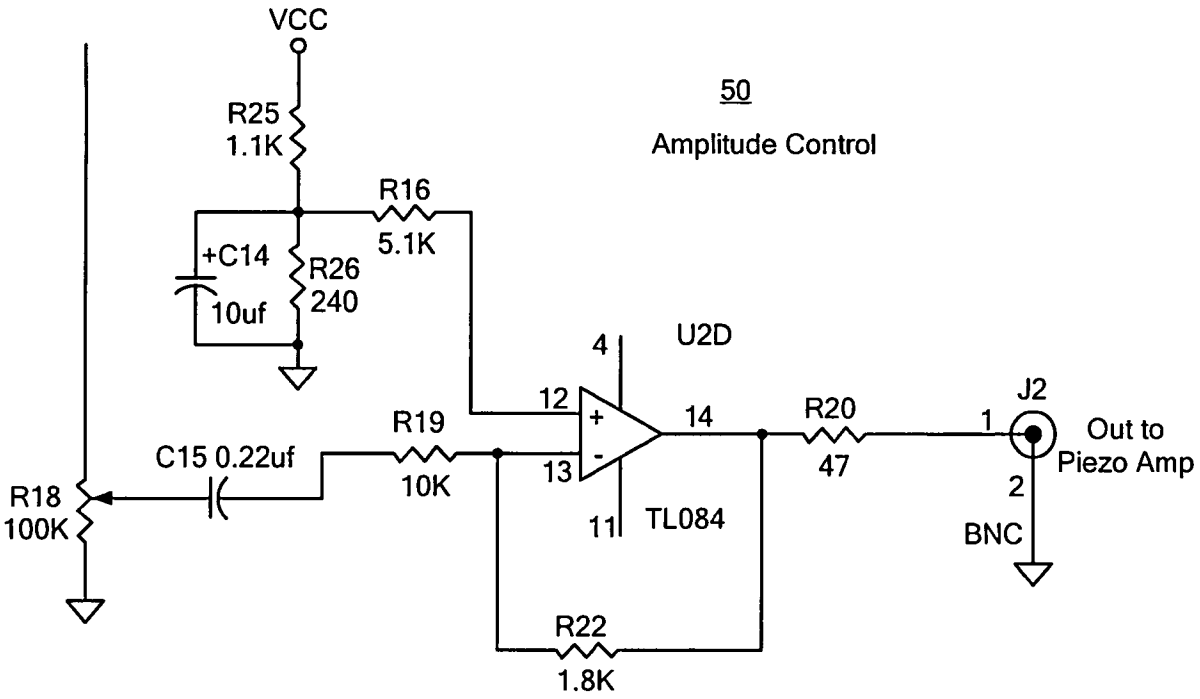
Figure 10:
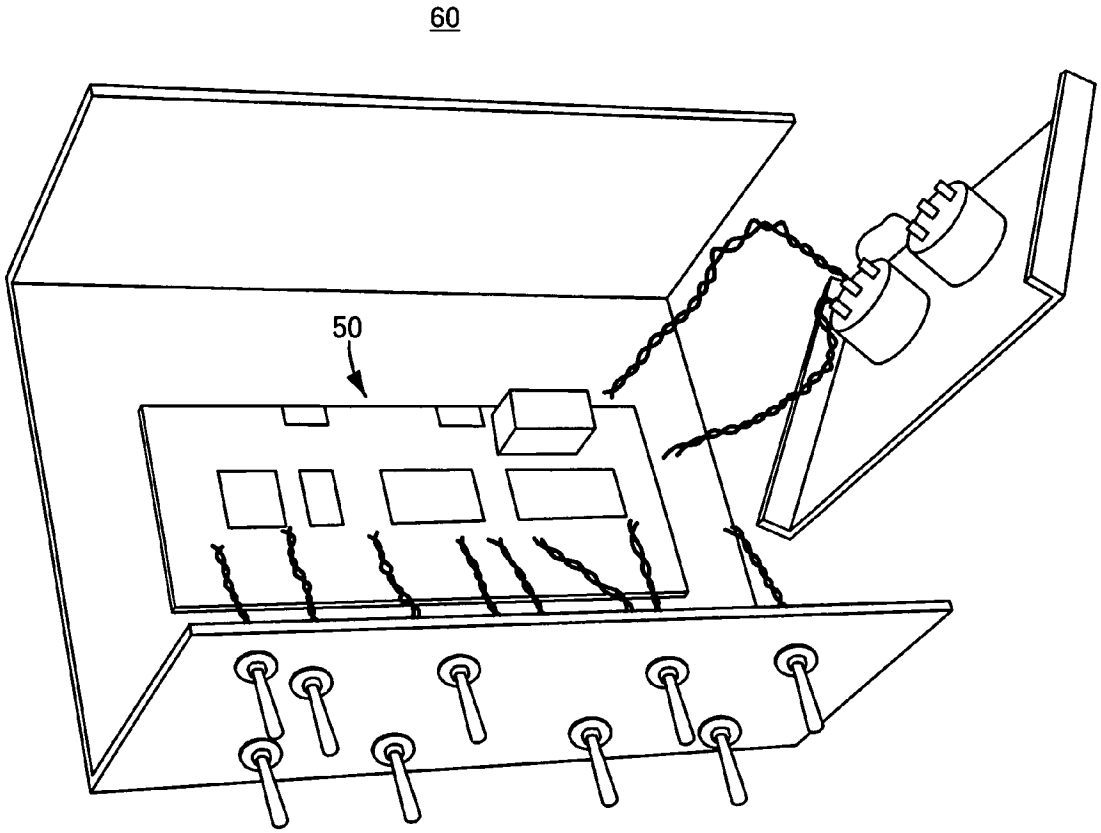
FIG. 10 is a photograph showing one example of a components box for the control circuit shown in FIG. 1.
Figure 11:
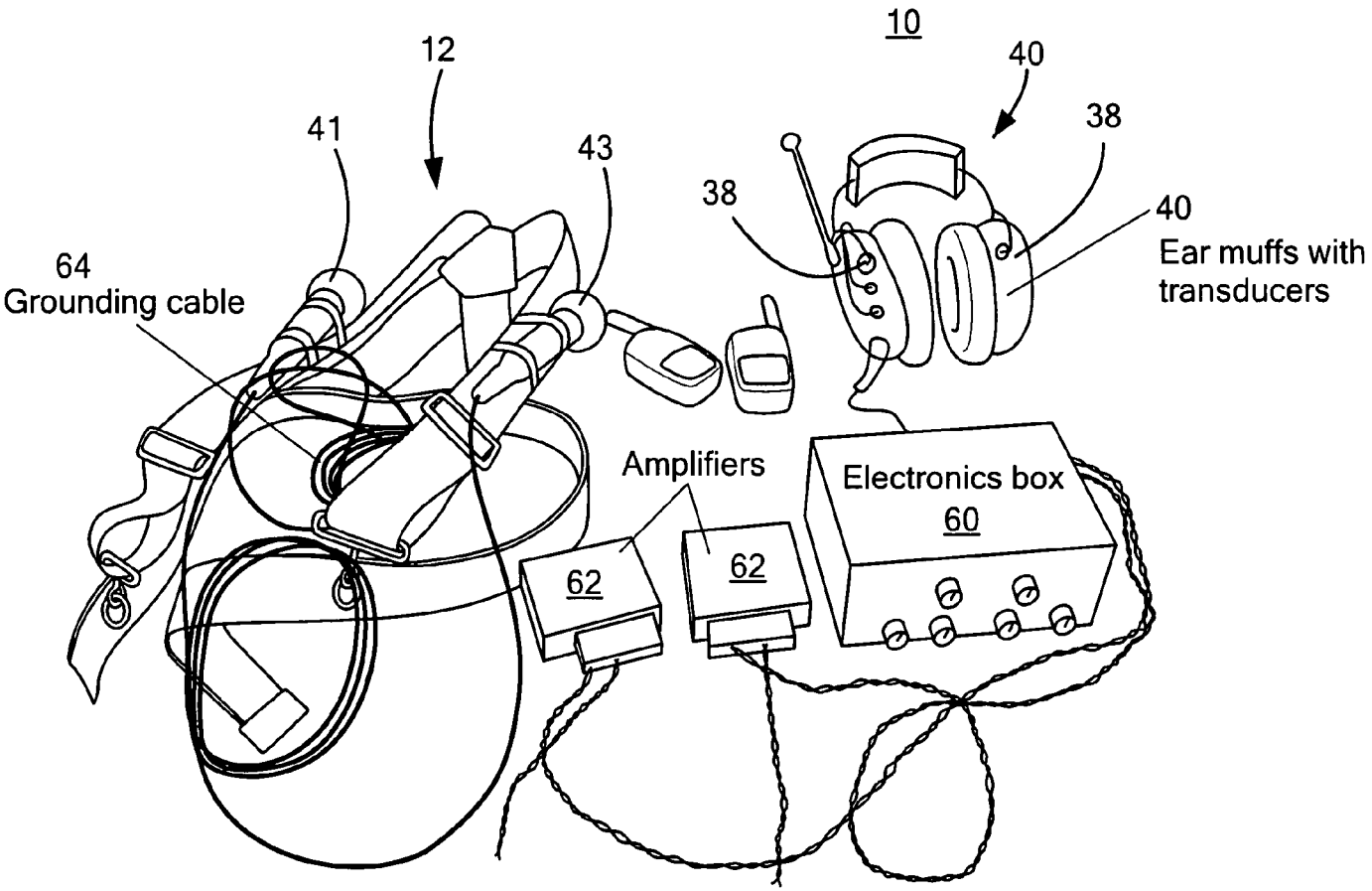
FIG. 11 is a photograph showing the primary components of one example of a prototype of the hearing protection system shown in FIG. 1.
Figure 12:
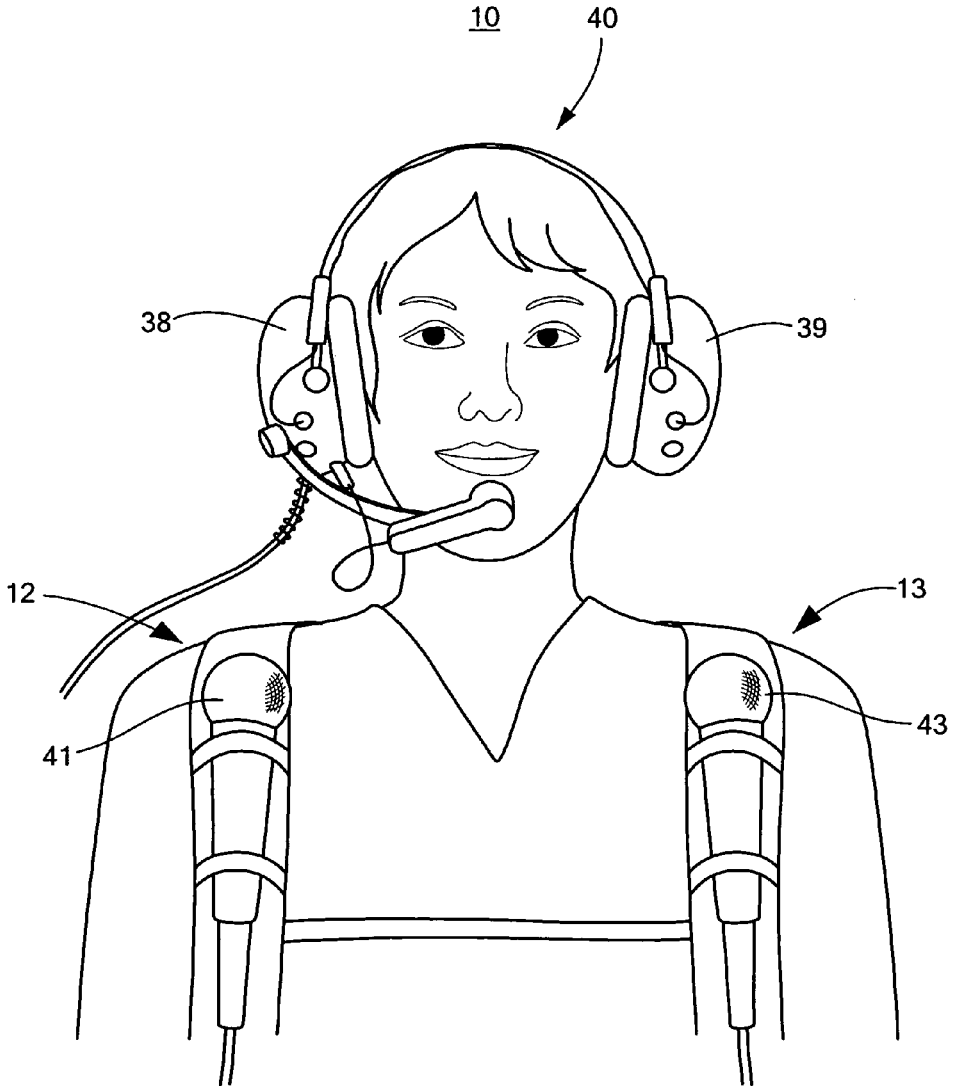
FIG. 12 is a photograph showing one example of the prototype shown in FIG. 11 in place on a user.

Hearing protection system 10, FIG. 1, preferably includes control circuit 50 coupled to detection subsystem 11 and one or more actuators 16, 18 as shown to perform the signal conditioning and inversion as needed. FIGS. 7, 8 and 9 show in further detail one example of primary electronic components of control circuit 50. Preferably control circuit 50, FIGS. 1 and 7-9, utilizes signal amplification at both the front-end and back-end of circuit 50 to preferably reduce the potential of signal distortion at the wide range of noise levels. Amplitude and gain adjustments may be made using knobs on a system electronics box, e.g., as shown by electronics box 60, FIGS. 10 and 11 or by an automatic control based on a transfer function equation (discussed below). FIG. 11 shows one example of the primary components of a prototype of one embodiment of hearing protection system 10 with headset 40 with earmuff 38 and/or earmuff 39 having the actuators discussed above therein, one or more sensors 12 configured, in this example, as microphones 41 and 43, electronic box 60, amplifiers 62 and grounding cable 64. FIG. 12 is a photograph showing one example of hearing protection shown in FIG. 11 in operation on a user. In one design, system 10, FIGS. 1-12, would preferably be miniaturized and mounted in its entirety within earmuff 38 and/or earmuff 39.

As discussed above, in order to achieve the most optimal preferred signal attenuation, the cancellation vibrations generated by actuators 16, 18, FIGS. 1-6B, are preferably are 180° out of phase with the bone conducted sound vibrations. The cancellation vibrations are also preferably matched in power to the bone conducted sound vibrations. In operation, the bone conducted sound vibrations are not necessarily in phase with the incoming sound due to effects of the discontinuous index of sound. Moreover, hearing protection system 10 preferably drives actuators 16, 18 at a phase offset in order for actuators 16, 18 to respond at the right phase. As known by those skilled in the art, the amplitude required may not be linear with the intensity of the incoming sound. The inventors hereof realized the for the transfer function of the human skull 22, e.g., as shown in FIGS. 1 and 3, this is not necessarily correct. In order to drive system at actuators 16, 18 at the ideal amplitude and phase for the cancellation vibrations to best attenuate the bone conducted sound vibrations, a closed-form solutions to the transfer function of the human skull is needed so that the calculation can becomes a single point calculation that can be carried out in real time.

Figure 13:
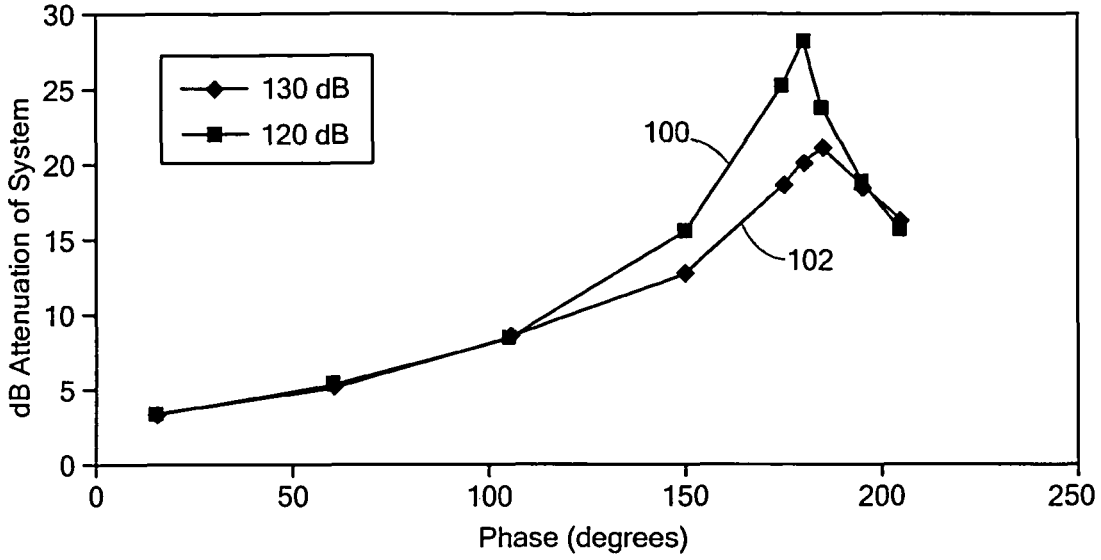
FIG. 13 is a graph showing one example of the attenuation results achieved using the hearing protection system shown in one or more of FIGS. 1-12.
Figure 14:
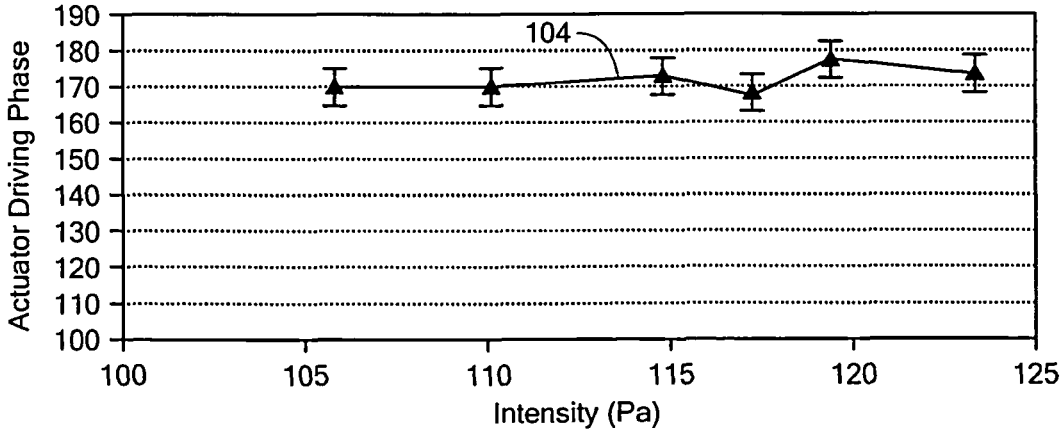
FIG. 14 is a plot showing one example of the relationship between sound intensity and phase of the actuators shown in one or more of FIGS. 1-12.

One example of accounting for such a phase is shown in FIG. 13. As can been seen by plots 100 and 102, a mismatch of about 5 degrees of phase loses less than 10% of the total attenuation. Tests were conducted on an ear seal mockup phantom to verify this at different sound levels. It was found that a relatively flat relationship exists between sound intensity and the phase that actuators 16, 18 must be driven at in order to achieve the best signal attenuation is shown by plot 104, FIG. 14.

In terms of the amplitude required for the cancellation vibrations generated by actuators 16, 18 of hearing protection system 10, the curve of the transfer function of human skull, FIGS. 1-2 was investigated. Such a curve may be represented in two segments: up to 4 kHz and beyond 4 kHz. The closed form solution to the fit is shown by equation (1) below:

$$2E\text{-}19f^6-4E\text{-}15f^5+2E\text{-}11f^4-7E\text{-}08f^3+0.0001f^2-0.063f+11.877 \text{ for } f\leq 4000 \quad (H(f)=-3E\text{-}08f^2+0.0013f-10.858 \text{ for } f>4000 \quad (1)$$

Figure 15A:
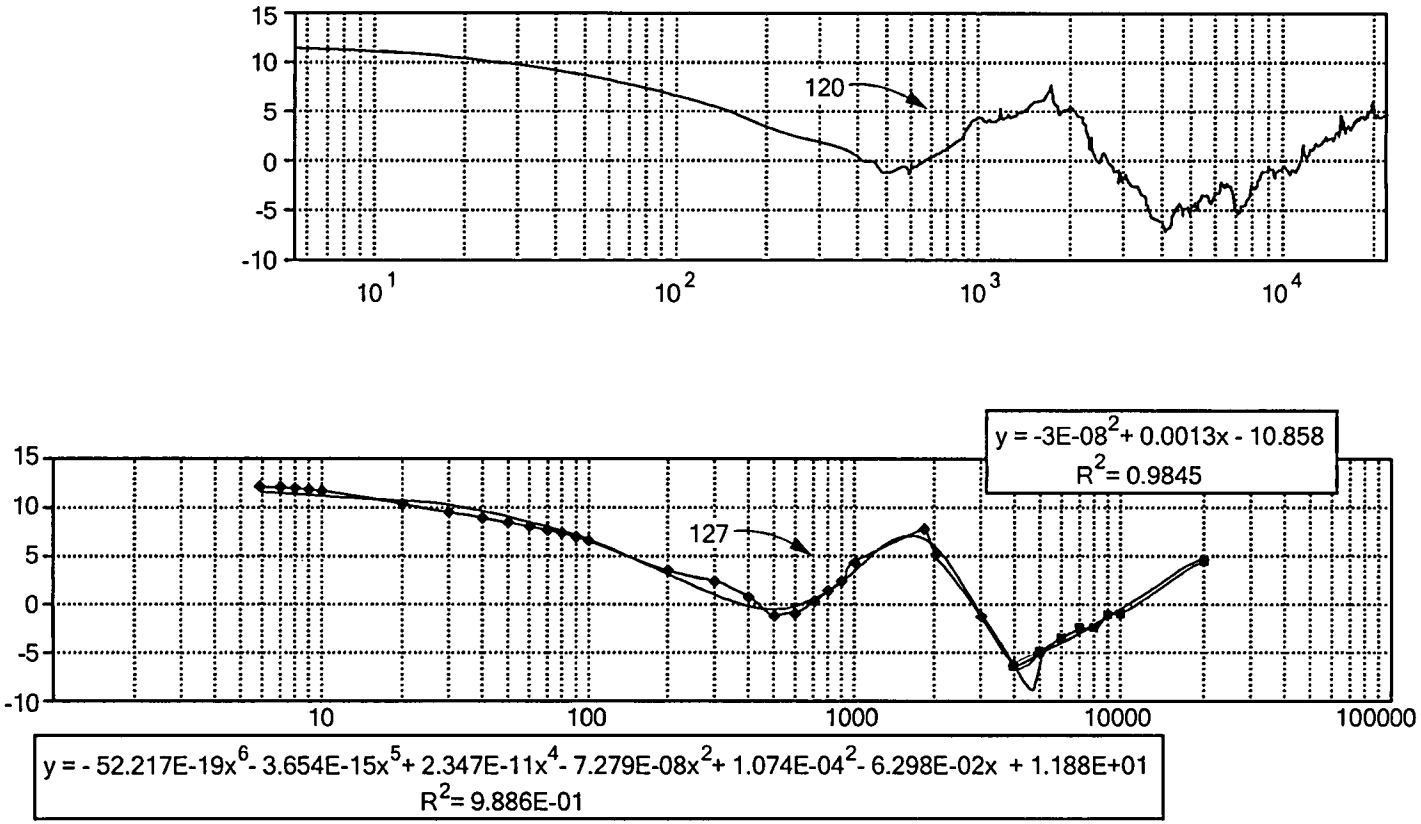
FIG. 15 shows plots of one example of the development of a transfer function of the human skull in accordance with this invention.
Figure 15B:
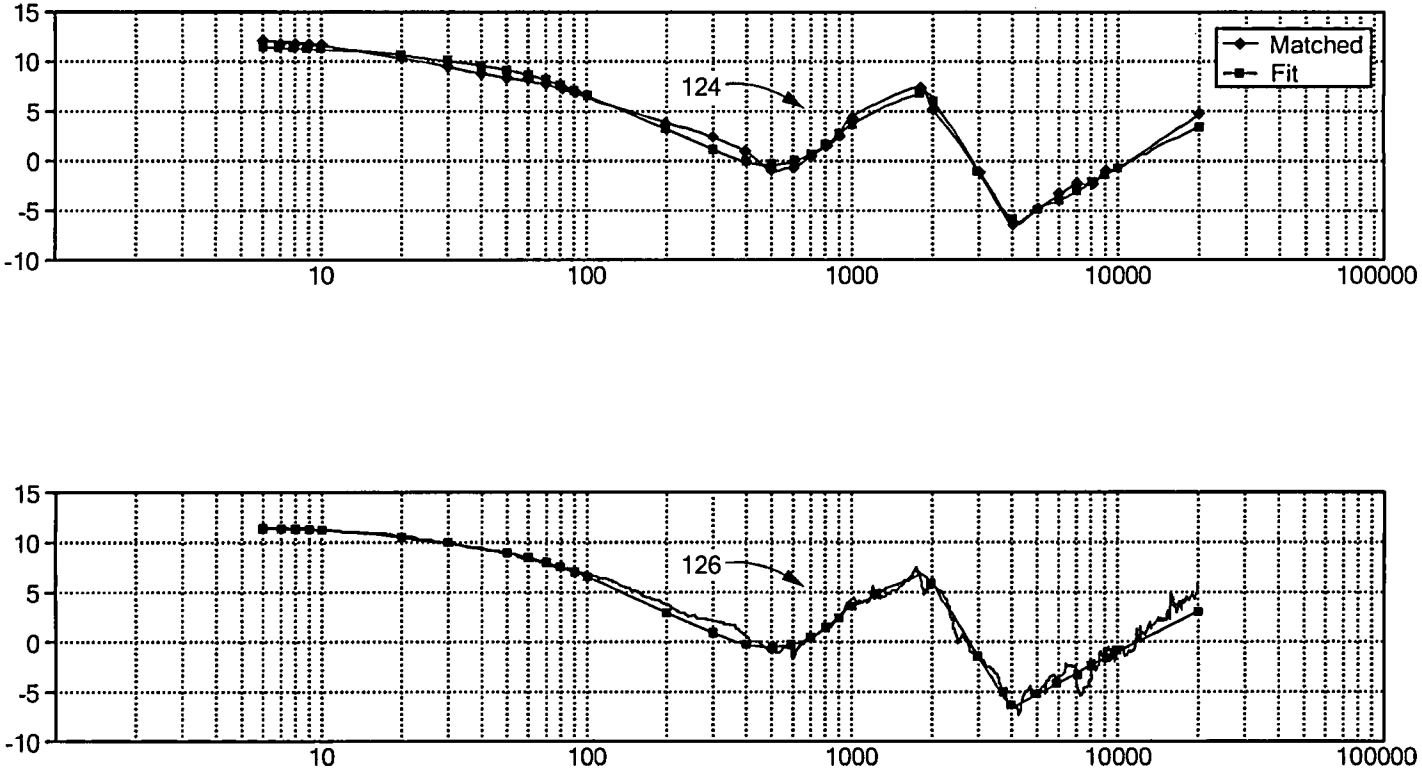

One example of such a transfer function development in accordance with hearing protection system 10 in one or more of FIGS. 1-12 is shown in plots 120, 122, 124, and 126, FIG. 15. The discontinuity at 4 kHz is 0.3 dB, or 5% of the value at 4 kHz. Overall, the maximum excursion appears to be no more than 1 dB, falling within the 50% excursion of the P:S ratio which we feel still give adequate signal attenuation.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A hearing protection system comprising:

a detection subsystem configured to determine bone conducted sound vibrations; and one or more actuators placed proximate a predetermined location on the skull of a user configured to generate cancellation vibrations out of phase with the bone conducted sound vibrations to mitigate the effect of bone conducted sound vibrations on the middle and/or inner ear of a user.

2. The system of claim 1 in which the one or more actuators are configured to generate the cancellation vibrations about 180° out of phase with the bone conducted sound vibrations.

3. The system of claim 1 in which the one or more actuators generate cancellation vibrations having about the same amplitude as the bone conducted sound vibrations.

4. The system of claim 1 in which the one or more actuators are placed proximate the temporal bone of the skull.

5. The system of claim 4 in which one of the one or more actuators is placed proximate the mastoid and another of the one or more actuators is placed proximate the squamous process.

6. The system of claim 1 in which the detection subsystem includes one or more sensors configured to measure the bone conducted sound vibrations.

7. The system of claim 1 in which the detection subsystem is configured to calculate the bone conducted sound vibrations by measuring sound vibrations in air.

8. The system of claim 1 further including a controller circuit coupled to the detection subsystem and the one or more actuators.

9. The system of claim 1 in which the one or more actuators are disposed in an earmuff of a headset.

10. The system of claim 9 in which the one or more actuators are disposed in the earmuff such that they are located proximate the temporal bone of the skull of a user.

11. The system of claim 10 in which one of the actuators is disposed in the earmuff such that it is proximate the mastoid and another of the actuators is disposed in the earmuff such that it is proximate the squamous process.

12. The system of claim 9 in which the detection subsystem is disposed in the earmuff.

13. The system of claim 6 in which the one or more sensors include a microphone.

14. The system of claim 1 in which the one or more actuators includes a piezoelectric transducer.

15. The system of claim 1 in which the one or more actuators includes a voice coil.

16. The system of claim 1 in which the one or more actuators includes a vibrating transducer.

17. A method of providing hearing protection to bone conducted sound vibrations, the method comprising:

determining bone conducted sound vibrations; and generating cancellation vibrations out of phase with the bone conducted sound vibrations to mitigate the effect of bone conducted sound vibrations on the middle and/or inner ear of a user.

18. The method of claim 13 further including the step of generating cancellation vibrations about 180° out of phase with the bone conducted sound vibrations.

19. The method of claim 11 further including the step of generating cancellation vibrations having about the same amplitude as the bone conducted vibrations.

* * * * *